US007073543B2

(12) United States Patent
Kobayashi et al.

(10) Patent No.: US 7,073,543 B2
(45) Date of Patent: Jul. 11, 2006

(54) MEDICINE FEEDING APPARATUS

(75) Inventors: Koichi Kobayashi, Ota (JP); Takashi Mori, Ota (JP)

(73) Assignees: Sanyo Electric Co., Ltd., Moriguchi (JP); Sanyo Electric Biomedical Co., Ltd., Moriguchi (JP)

( * ) Notice: Subject to any disclaimer, the term of this patent is extended or adjusted under 35 U.S.C. 154(b) by 55 days.

(21) Appl. No.: 10/984,873

(22) Filed: Nov. 10, 2004

(65) Prior Publication Data

US 2005/0115634 A1 Jun. 2, 2005

(30) Foreign Application Priority Data

Dec. 1, 2003 (JP) ..... 2003-401212

(51) Int. Cl.
*B65B 1/04* (2006.01)

(52) U.S. Cl. ..... 141/104; 141/98; 221/242; 221/129; 193/32

(58) Field of Classification Search ..... 141/2, 141/18, 104, 98, 286; 221/242, 129; 193/32
See application file for complete search history.

(56) References Cited

U.S. PATENT DOCUMENTS 3,738,507 A * 6/1973 Livingston ..... 222/457
3,938,700 A * 2/1976 Camp et al. ..... 221/109
5,348,061 A * 9/1994 Riley et al. ..... 141/104
5,812,410 A * 9/1998 Lion et al. ..... 700/231

FOREIGN PATENT DOCUMENTS

JP 57-5282 2/1982
JP 2003-237702 8/2003

* cited by examiner

*Primary Examiner*—Steven O. Douglas
(74) *Attorney, Agent, or Firm*—Armstrong, Kratz, Quintos, Hanson & Brooks, LLP

(57) ABSTRACT

An object of the invention is to provide a medicine feeding apparatus in which it is possible to prevent a medicine from being broken by well absorbing and reducing a kinetic energy at a time of discharging the medicine even in the case that a downsizing and a densification are promoted for making a discharge speed of the medicine higher, and it is possible to efficiently guide the medicine to an outlet portion of a hopper. Further, the medicine feeding apparatus is provided with a main body, a plurality of tablet cases receiving medicines, a chute received in the main body and through which the medicine discharged from the tablet case comes down, a hopper received in the main body, provided in correspondence to a lower side of the chute and collecting the medicines, and a filling apparatus received in the main body and filling the medicines collected by the hopper in a drug packing paper or a container. The hopper has a curtain for preventing the medicine passing through the chute from jumping up or rotating in the hopper caused by drop and absorbing a kinetic energy.

15 Claims, 9 Drawing Sheets

MEDICINE FEEDING APPARATUS

BACKGROUND OF THE INVENTION

The present invention relates to a medicine feeding apparatus which feeds a medicine received in a tablet case to a package bag in accordance with a kind of medicine and a quantity designated by a prescription, in a hospital, an ethical pharmacy or the like, and more particularly to a medicine feeding apparatus provided with a hopper which is attached to a main body so as to be freely drawn, and a curtain which can maintain a discharge speed of the medicine at a high speed while well absorbing a kinetic energy of the medicine in the hopper.

In conventional, in the hospital and the ethical pharmacy, for example, as shown in Japanese Utility Model Publication No. 57-5282, the medicine prescribed by a doctor is supplied to a patient by using a medicine feeling apparatus (called as a tablet packaging machine in the document mentioned above). In this system, there are automated all the works from an extracting work to a packaging work comprising the steps of discharging the medicine (a tablet, a capsule agent or the like) in accordance with the kind and the quantity described in the prescription from a discharge drum (called as an aligning table in the document mentioned above) within a tablet case one by one, collecting by a hopper via a chute, and thereafter packaging by a packing paper.

On the other hand, as shown in Japanese Unexamined Patent Publication No. 2003-237702, there is a structure in which the tablet case is attached so as to be freely drawn from the main body of the medicine feeding apparatus and be detachable, in order to make it easy to extremely easily execute a maintenance work such as a cleaning work, a replacing work and the like of the tablet case.

In this case, in the medicine feeding apparatus as shown in the former document, the tablet case, the chute, the hopper and the like are contaminated by micro powders or the like generated from the medicine in correspondence to an impact caused by the medicine drop, and there is a case that the micro powders accumulated in a portion of the hopper positioned at the final stage are erroneously enclosed in the packing paper. However, in the conventional medicine feeding apparatus, since the structure is not made such that it is possible to well absorb the impact in the hopper in which the kinetic energy caused by the drop of the medicine becomes largest (positioned at the final stage), the medicine can not stand up to the impact force generated at a time when the medicine collides with the hopper in accordance with an increase of the speed for discharging the medicine, so that it is unavoidable that a part of the medicine is broken. Further, since the micro powders of the medicine are generated in accordance with the breakage, it is extremely hard to prevent the contamination caused by the micro powders.

On the other hand, in the medicine feeding apparatus shown in the latter document, since the downsizing and densification is promoted for making the discharge speed of the medicine high, the kinetic energy of the medicine is increased in proportion to the speed. Accordingly, a cushioning material for efficiently absorbing and reducing the energy generated by the collision at the increased speed of the medicine is not considered.

SUMMARY OF THE INVENTION

An object of the present invention is to provide a medicine feeding apparatus in which it is possible to prevent a medicine from being broken by well absorbing and reducing a kinetic energy at a time of discharging the medicine even in the case that a downsizing and a densification are promoted for making a discharge speed of the medicine higher, and it is possible to efficiently guide the medicine to an outlet portion of a hopper. Further, in addition, an object of the present invention is to provide a medicine feeding apparatus which can inhibit and prevent the medicine from jumping up in the hopper portion.

In other words, in accordance with the present invention, there is provided a medicine feeding apparatus (1) comprising:

a main body (2);

a plurality of tablet cases (6) receiving medicines;

a chute (12) received in the main body and through which the medicine discharged from the tablet case comes down;

a hopper (14) received in the main body, provided in correspondence to a lower side of the chute and collecting the medicines; and a filling apparatus (15) received in the main body and filling the medicines collected by the hopper in a drug packing paper or a container, wherein the hopper (14) has a curtain (41, 45, 49) for preventing the medicine passing through the chute from jumping up or rotating in the hopper caused by drop and absorbing a kinetic energy.

Further, the medicine feeding apparatus (1) in accordance with the present invention is structured such that a first curtain (41) absorbing the kinetic energy of the medicine is provided in correspondence to an outlet portion (14A) of the hopper (14).

Further, the medicine feeding apparatus (1) in accordance with the present invention is structured such that a second curtain (45) inhibiting and preventing the medicine from jumping up is provided in a direction (at a position) where the medicine coming down from the chute (12) is reflected by the first contact hopper portion (14).

Further, the medicine feeding apparatus (1) in accordance with the present invention is structured such that the second curtain (45) is made of resin, and is rotatably held to the hopper (14).

Further, the medicine feeding apparatus (1) in accordance with the present invention is structured such that a gap (T) through which the medicine passes is formed between the second curtain (45) and the hopper (14).

Further, the medicine feeding apparatus (1) in accordance with the present invention is structured such that the medicine feeding apparatus (1) is provided with a partition member (35) controlling a movement in a rotational direction of the medicine which is in contact with the hopper (14) having a slope surface.

Further, the medicine feeding apparatus (1) in accordance with the present invention is structured such that a third curtain (49) extending through the hopper (14) and absorbing a kinetic energy in a rotational direction of the medicine is provided in the partition member (35).

Further, the medicine feeding apparatus (1) in accordance with the present invention is structured such that the third curtain (49) is made of transparent resin.

Further, the medicine feeding apparatus (1) in accordance with the present invention is structured such that the third curtain (49) and the first curtain (41) are positioned on the same line.

Further, the medicine feeding apparatus (1) in accordance with the present invention is structured such that the first curtain (41) is constituted by a roller screen member in which one end is rotatably supported.

Further, the medicine feeding apparatus (1) in accordance with the present invention is structured such that the roller screen member (41) is constituted by a shaft portion (42) supported to the partition member (35), and a plurality of absorbers (43) in which one end is rotatably supported to the shaft portion.

Further, the medicine feeding apparatus (1) in accordance with the present invention is structured such that the roller screen member (41) is attached to a lower end of the partition member (35).

Further, the medicine feeding apparatus (1) in accordance with the present invention is structured such that the partition member (35) and the roller screen member (41) are made of stainless steel.

Further, the medicine feeding apparatus (1) in accordance with the present invention is structured such that a part of the first curtain (41) faces to an outlet (14A) of the hopper (14).

In accordance with the present invention, there is provided a medicine feeding apparatus (1) comprising:

a main body (2);

a plurality of tablet cases (6) receiving medicines;

a chute (12) received in the main body and through which the medicine discharged from the tablet case comes down;

a hopper (14) received in the main body, provided in correspondence to a lower side of the chute and collecting the medicines; and a filling apparatus (15) received in the main body and filling the medicines collected by the hopper in a drug packing paper or a container, wherein the hopper (14) has a first curtain (41) provided in correspondence to an outlet portion (14A) thereof and absorbing a kinetic energy of the medicine, a second curtain (45) provided in a direction (at a position) where the medicine coming down from the chute (12) is reflected by the first contact hopper portion (14) and inhibiting and preventing the medicine from jumping up, a partition member (35) controlling a movement in a rotational direction of the medicine which is in contact with the hopper (14) having a slope surface, and a third curtain (49) provided in the partition member, extending through the hopper and absorbing a kinetic energy in a rotational direction of the medicine, and absorbs the kinetic energy of the medicine as well as preventing the medicine passing through the chute from jumping up or rotating in the hopper caused by drop.

DETAILED DESCRIPTION OF THE PREFERRED EMBODIMENT

A description will be in detail given below of an embodiment in accordance with the present invention with reference to the accompanying drawings.

Figure 1:
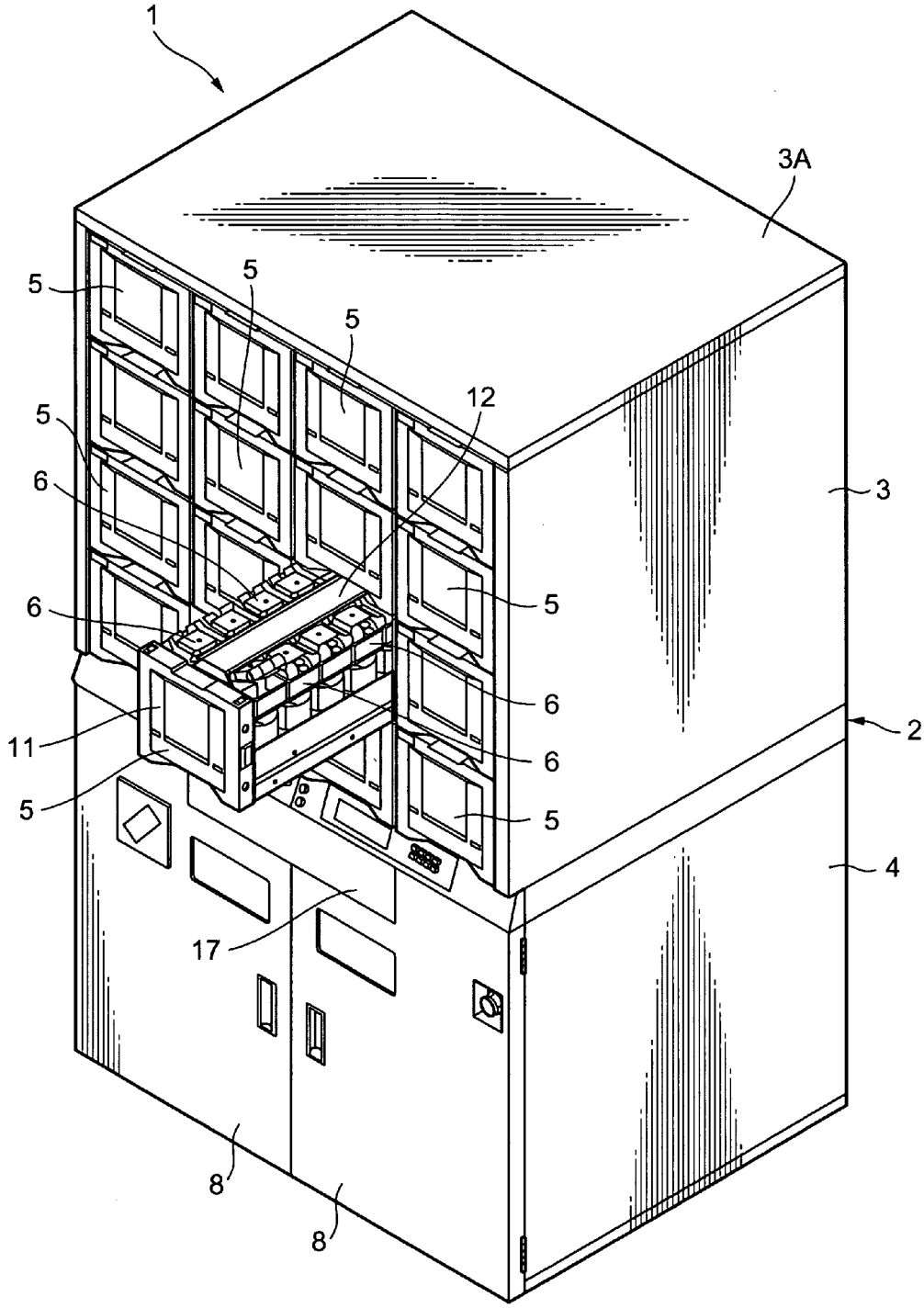
FIG. 1 is a perspective view of a state in which a certain drawer is drawn out in a medicine feeding apparatus in accordance with the present invention.

A medicine feeding apparatus 1 in accordance with the present invention is installed in a hospital, an ethical pharmacy or the like, and carries out all the works from an extracting work of the medicine to a packing work of the medicine comprising the steps of discharging the medicine (the tablets, the capsule agent and the like) from a discharge port within a tablet case one by one in accordance with the kind and the quantity described in the prescription, collecting the medicine by a hopper via a chute serving as a free-fall passage by utilizing a weight of the medicine to one position, and thereafter packaging the medicine by a packing paper, in a series of mechanisms, whereby all the steps are automated. As shown in FIG. 1, the medicine feeding apparatus 1 is constituted by a main body 2 having a vertically longer rectangular shape, and a personal computer (not shown) for controlling.

The main body 2 is constituted by an upper structure body 3 and a lower structure body 4 which can be separated from each other, and is structured such that the upper structure body 3 is laminated on the lower structure body 4 so as to be connected thereto. Further, a case receiving portion in which a front side and upper and lower sides are open is structured within the upper structure body 3 for receiving a tablet case 6 mentioned below, and a top surface of the case receiving portion is closed by a detachable top plate 3A.

Figure 4:
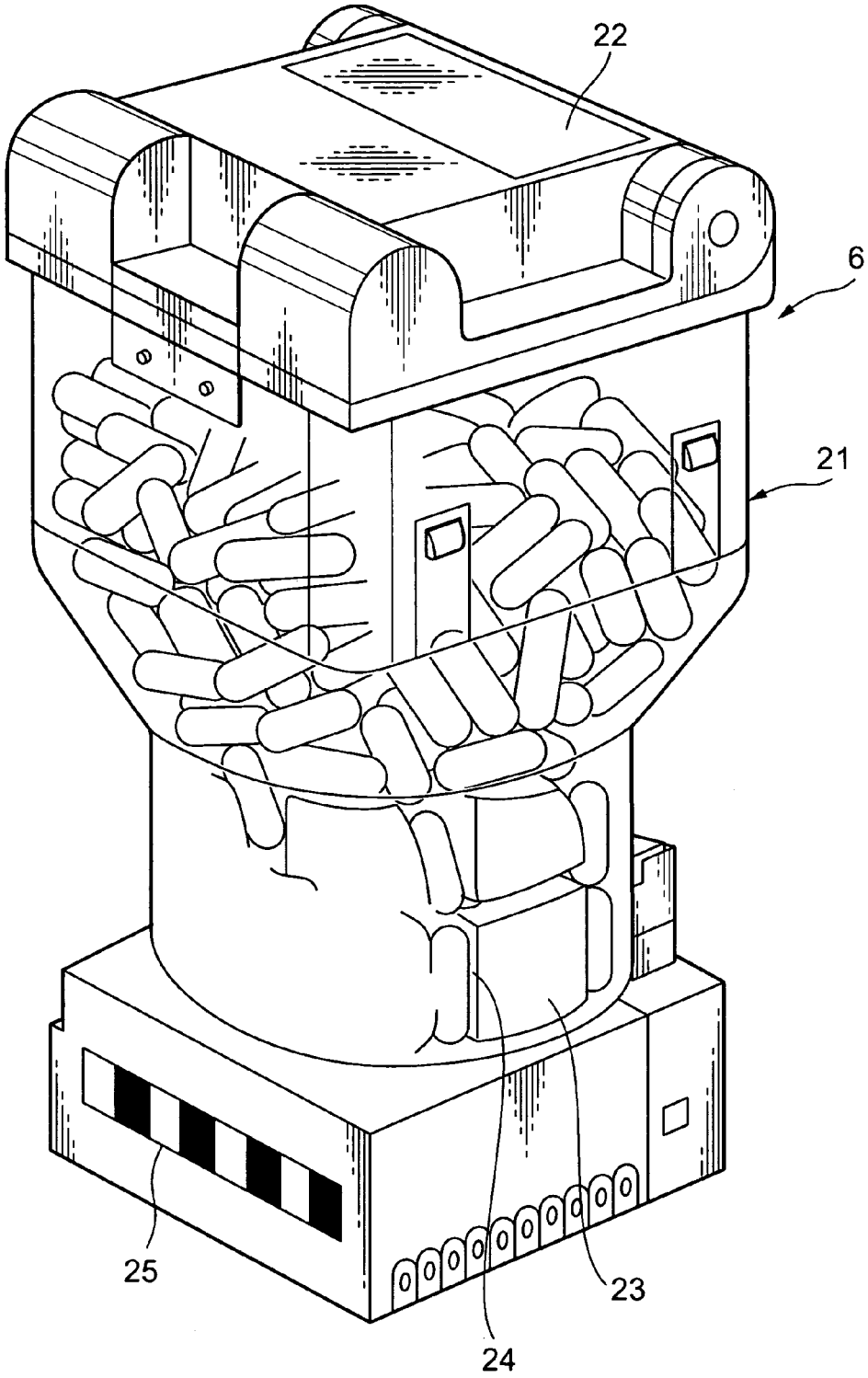
FIG. 4 is a perspective view of a tablet case in accordance with the present invention.

Shelves 5, . . . serving as drawers are provided at four lateral rows and five vertical stages (in conformity to twenty) within the case receiving portion of the upper structure body 3 so as to be freely drawn. A door panel 11 is attached to a front end of each of the shelves 5, and the respective door panels 11 close a front opening of the upper structure body 3 in a state in which all the shelves 5, . . . are received within the case receiving portion. A passage 12 open to upper and lower sides is formed in a center of the shelf 5 so as to extend longitudinally, and forms a passage through which the medicine discharged from the tablet case 6 of the shelf 5 positioned above the shelf drops down. Drive bases (not shown) of the tablet case 6 are attached to both right and left sides of the passage 12 longitudinally at eight positions (totally sixteen positions in the right and left sides) in parallel in a longitudinal direction (all of them is not illustrated in accordance with convenience of the drawings). In this case, as shown in FIG. 4, the tablet case 6 is constituted by the drive base and a receiving container 21 connected to the above thereof.

Further, the lower structure body is open in a front surface and an upper surface, and is communicated with the upper structure 3 in the upper surface. Further, a shutter 13, a hopper 14, a packing machine 15 and the like serving as a filling apparatus mentioned below are received and placed within the lower structure body 4, and a front opening thereof is closed by double lower panels 8 and 8 so as to be freely opened and closed.

Figure 2:
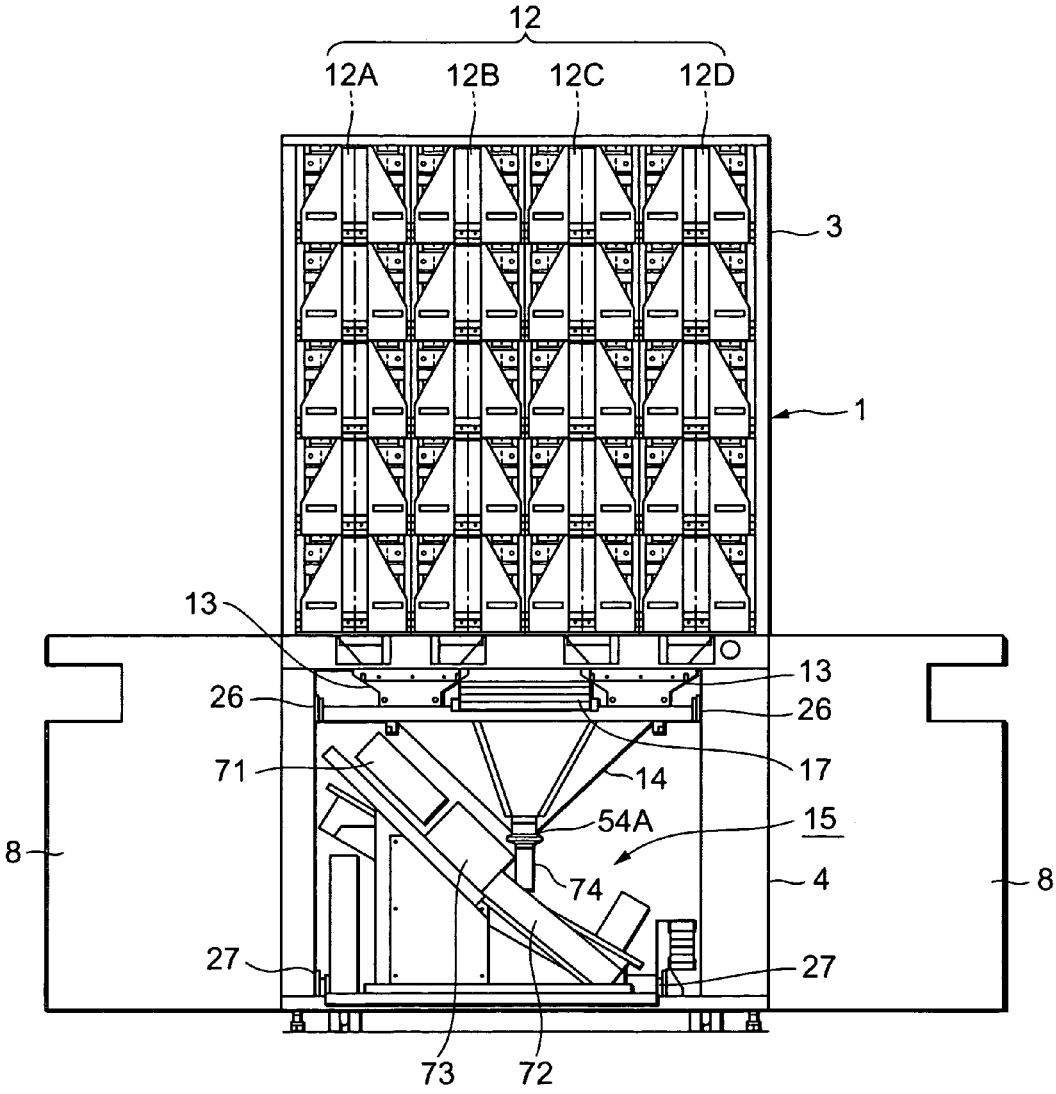
FIG. 2 is a front elevational view of the medicine feeding apparatus in a state in which a door panel is detached from each of the drawers in accordance with the present invention.

Further, as shown in FIG. 2, in a state in which the respective shelves 5 are received within the case receiving portion, the passages 12 of the respective shelves 5 positioned vertically correspond to each other, and in the case that the corresponding relation matches (in other words, the shelves 5 in the vertical relation are all compressed to fixed positions), a vertically communicated series of chute is structured. Accordingly, in this embodiment, four rows of chutes 12A, 12B, 12C and 12D extending vertically are structured within the case receiving portion.

Figure 3:
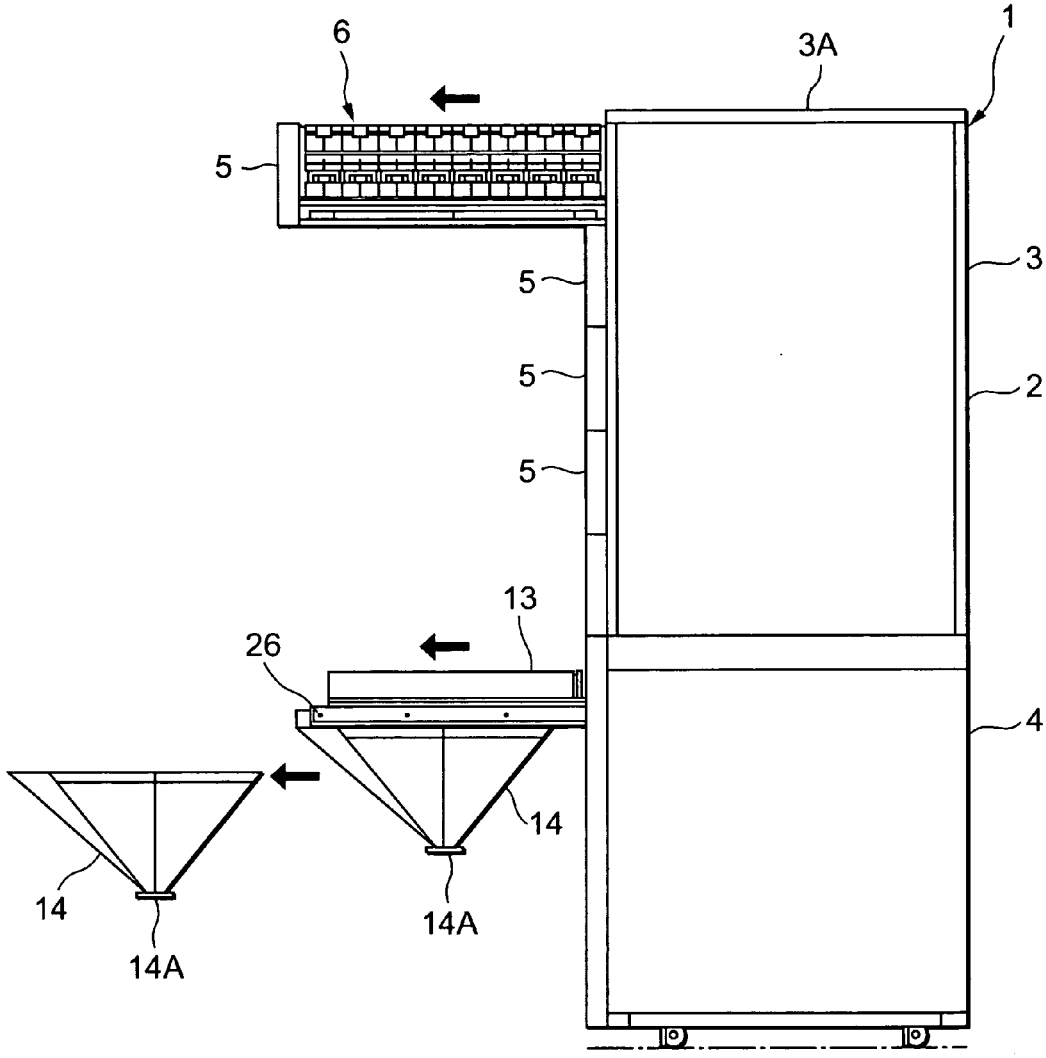
FIG. 3 is a side elevational view in a state in which the drawers and a hopper are drawn out in the medicine feeding apparatus in accordance with the present invention.

Next, as shown in FIGS. 2 and 3, two shutters 13 and 13 are laterally provided in an upper portion of the lower structure body 4 in a parallel manner. The respective shutters 13 and 13 correspond to the lower side of the chute 12 in the above of the shutters, the shutter 13 on the right side as one faces corresponds to the chutes 12C and 12D on the right end as one faces and a left side thereof, and the shutter 13 on the left side as one faces corresponds to the chutes 12A and 12B on the left end as one faces and a right side thereof. Further, each of the shutters 13 plays a part in temporarily receiving the medicine coming down from each of the chutes 12 to a hopper 14 mentioned below.

Further, the hopper 14 is provided within the lower structure body 4 in correspondence to the lower side of each of the shutters 13 and 13. The hopper 14 is formed in a rectangular funnel shape which is widely opened at an upper surface and is narrowed toward a lower end, and is structured such as to receive the medicine coming down from each of the chutes 12 and passing through the shutters 13 and 13 so as to discharge from an opening 14A corresponding to an outlet portion formed in the lower end thereof.

Further, right and left sides of an upper end of the hopper 14 are detachably screwed to drawer rails 26 and 26 attached to right and left sides of an upper portion within the lower structure body 4, and the respective shutters 13 and 13 are positioned in an upper side of the drawer rails 26 and 26 so as to be detachably screwed to the drawer rails 26 and 26. accordingly, the hopper 14 and the shutters 13 and 13 are simultaneously drawn freely to a front side from an inner side of the lower structure body 4 in a state of opening the lower panels 8 and 8, and are made detachable with respect to the drawer rails 26 and 26 in a state of being drawn.

Further, an additional medicine feeder (UTC) 17 is attached to the center of the upper portion of the lower structure body 4 so as to be positioned between both the shutters 13 and 13. In this case, the additional medicine feeder 17 is attached so as to be freely drawn independently from the open or close of the lower panels and be detachable, without being covered by the lower panels 8 and 8 (refer to FIGS. 1 and 2). The additional medicine feeder 17 is a feeder for optionally feeding a special additional medicine which is not frequently discharged in comparison with the medicines received in the tablet case 6 mentioned above so as to be discharged, and the lower surface of each of the containers is opened and closed by each of the shutter mechanisms. The additional medicine feeder 17 is positioned directly above the hopper 14 without being through the shutter 13, and is communicated with the inner portion thereof.

On the other hand, as shown in FIG. 4, the receiving container 21 of the tablet case 6 is open to an upper surface, and the opening is closed by a lid 22 which is freely opened and closed. Further, a discharge drum 23 is attached to a bottom portion within the receiving container 21, and a plurality of vertical grooves 24 are formed around a side surface of the discharge drum 23 at a predetermined interval. The medicine filled from the upper surface opening into the receiving container 21 (by opening the lid 22) enters into the vertical groove 24 of the discharge drum 23 two by two vertically. Further, an optically distinct identification code (a bar code or the like) 25 is attached on a lower side surface of the receiving container 21. The identification code 25 is a code for identifying the kind of the medicine filled within the receiving container 21.

The receiving container 21 mentioned above is mounted on the drive base which is mentioned above, however, is not illustrated, and is detachably connected to the drive base. In this case, the identification code 25 is attached so as to be directed to an outer side of the shelf 5 (an opposite side to the passage 12), and on the contrary, an outlet portion of the discharge drum 23 is attached so as to be directed to an inner side of the shelf 5, that is, the same side as the passage 12. Accordingly, the tablet case 6 is structured. At this time, the discharge drum 23 is detachably engaged with a drive shaft of a drum motor (both of which are not illustrated). Further, when the drum motor is forward driven, the discharge drum 23 is forward rotated, the vertical groove 24 thereof sequentially matches to the above of the discharge port of the drive base, and the medicine in the inner portion thereof free automatically falls toward the discharge chute 13 one by one.

Figure 5:
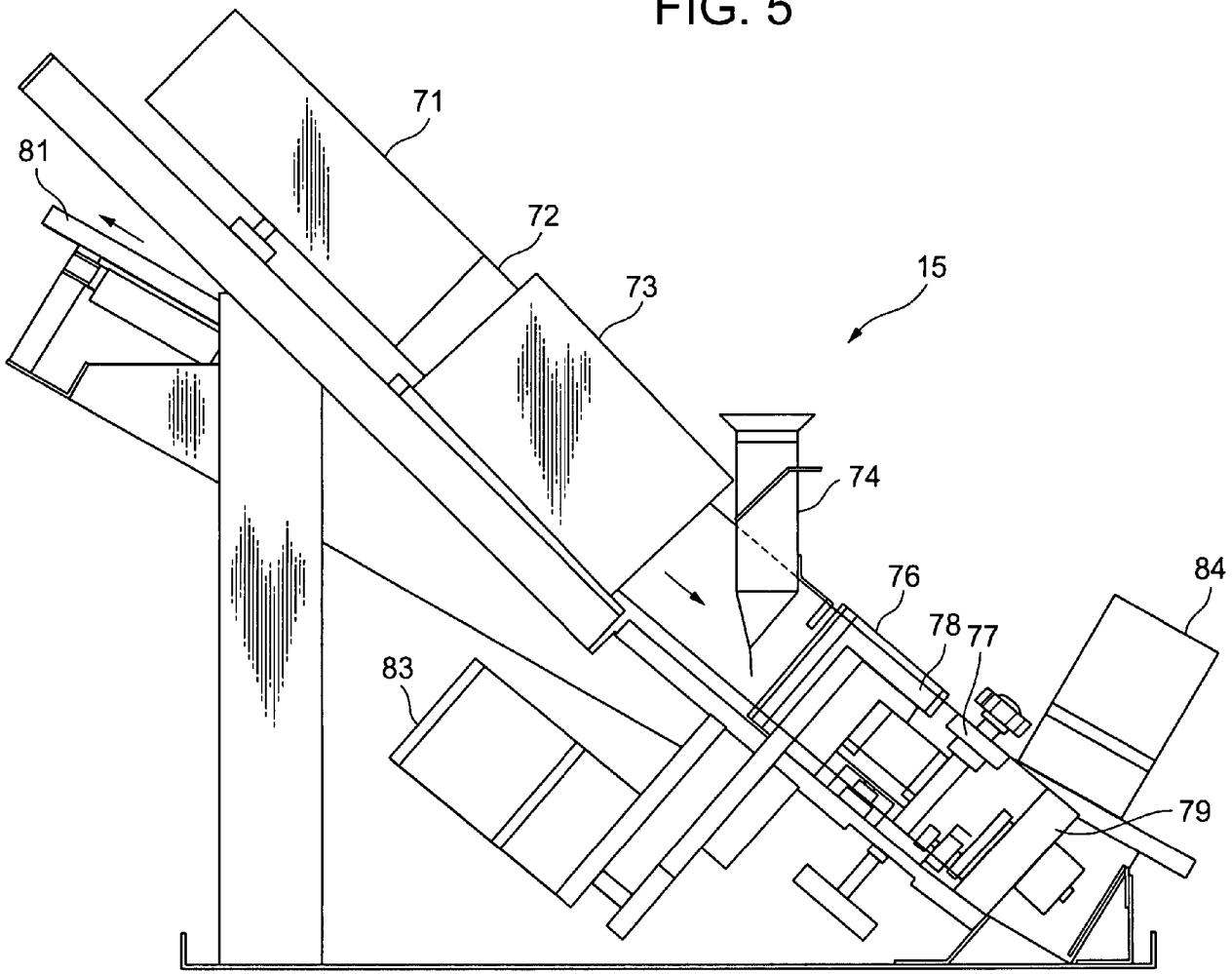
FIG. 5 is a side elevational view of a filling apparatus (a packing machine) in accordance with the present invention.

Next, a description will be given of a structure of the packing machine 15 mentioned above with reference to FIG. 5. The packing machine 15 is detachably screwed to drawer rails 27 and 27 attached to the right and left sides of the bottom surface within the lower structure body 4. Accordingly, the packing machine 15 is freely drawn to the forward side from the inner side of the lower structure body 4 in a state of opening the lower panels 8 and 8, and is made detachable to the drawer rails 27 and 27 in a state of being drawn.

Reference numeral 71 denotes a roll formed by winding a packing paper 72 (structuring a container) which can be thermally welded therearound, reference numeral 73 denotes a printer, reference numeral 74 denotes a nozzle attached to the lower end opening 14A of the hopper 14, reference numeral 76 denotes a thermal seal head constituted by a silicone rubber, reference numeral 77 denotes a roller conveying the packing paper 72 drawn out from the roll 71, reference numeral 79 denotes a cutter cutting the packing paper 72, and reference numeral 81 denotes a conveyor conveying the divisionally packed and cut packing paper 72 to an output port 82 provided in the lower panel 4. The conveyor 81 is sequentially provided along a conveying path of the packing paper 72. In this case, reference numeral 83 denotes a motor for actuating the thermal seal head 74, reference numeral 78 denotes a motor driving the roller 77, and reference numeral 84 denotes a motor of the conveyor 81.

The packing paper 72 wound around the roll 71 is opened in the upper surface, has an approximately V-shaped cross section folded at the lower end, is drawn to a right obliquely downward side from the roll 71 by the roller 77 or the like, and thereafter is applied a printing on a surface thereof by the printer 73 in accordance with a manner mentioned below. Next, the medicine discharged from the nozzle 74 is thrown in the packing paper 72, and the packing paper 72 is sectioned one by one by the thermal welding by means of the thermal seal head 76. The packing paper 72 sectioned and divisionally packed is next cut by the cutter 79, and is conveyed to the output port 82 in the left upper side as one faces by the conveyor 81.

Figure 6:
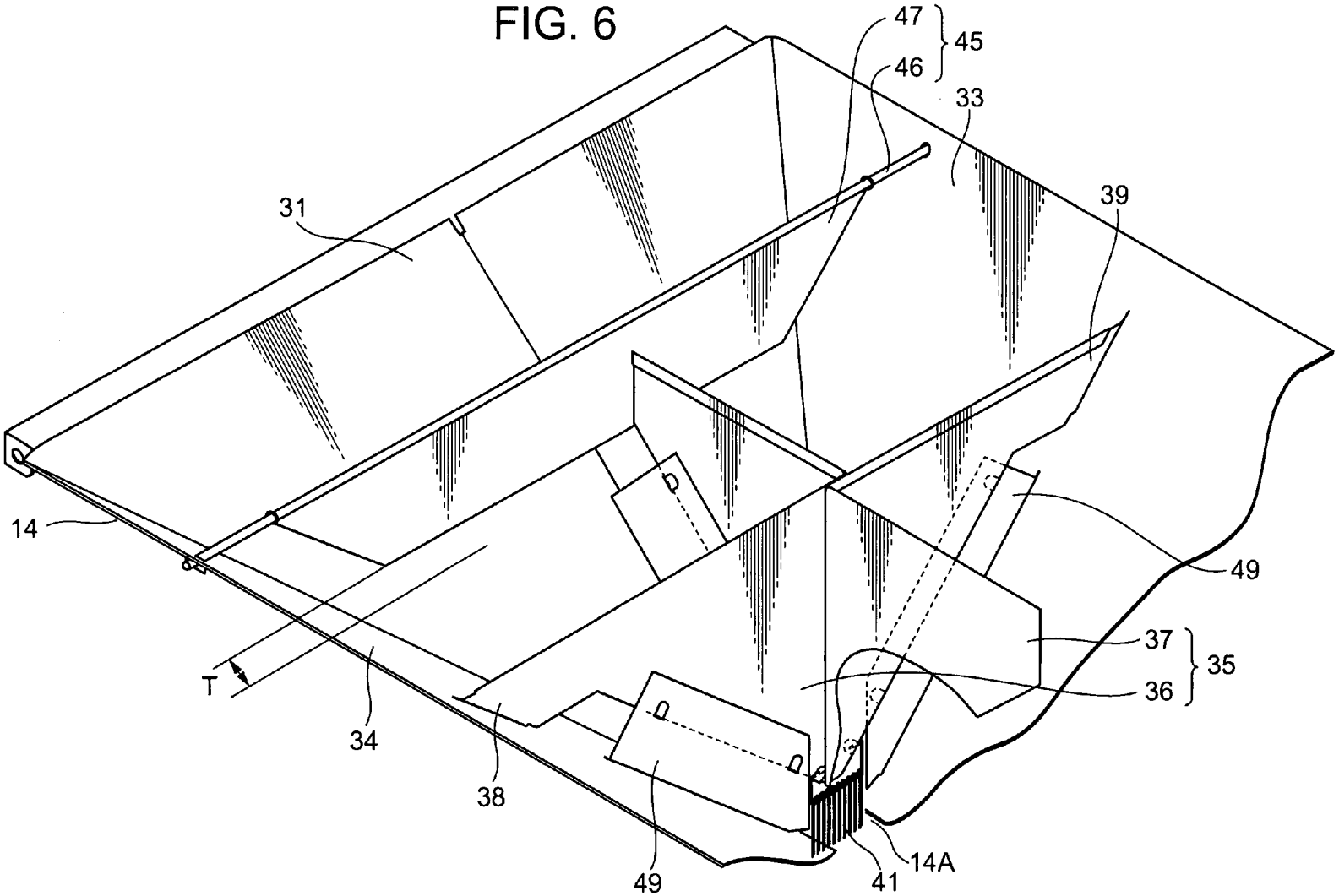
FIG. 6 is a perspective view of a main portion in a hopper portion in accordance with the present invention.
Figure 7:
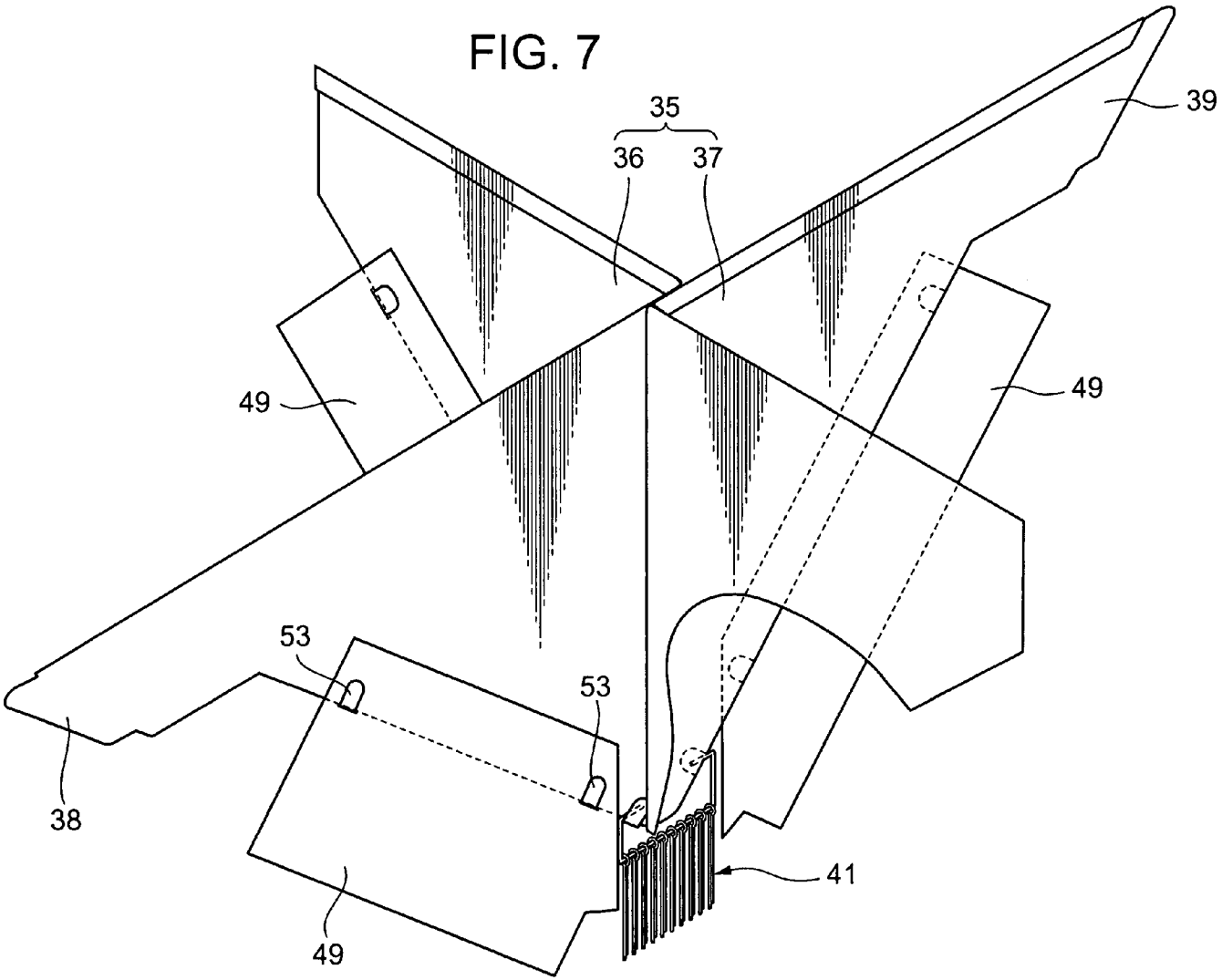
FIG. 7 is a perspective view of a partition member and a first curtain in accordance with the present invention.

Next, a description will be given of a structure for well absorbing and reducing the kinetic energy at a time of discharging the medicine from the shutter 13 by the hopper 14 so as to prevent the medicine from being broken and efficiently guiding the medicine to the outlet portion of the hopper, with reference to FIGS. 6 to 9. In FIG. 6, the hopper 14 having a rectangular funnel shape which is widely opened at an upper surface and is narrowed toward a lower end is formed by a corrosion resisting material, for example, a stainless steel, positively receives the medicine coming down from the chute 13 by the right and left slope surfaces 31 so as to guide the medicine, positively receives the medicine coming down from the additional medicine feeder 17 by the front slope surface 33 so as to guide the medicine to the lower side, collects the medicine in the opening portion 14A corresponding to the outlet portion formed in the lower end portion thereof, and discharges the medicine to the packing machine 15 positioned at the rear stage.

It is impossible to inhibit and prevent the medicine from jumping up or rotating in the hopper portion due to the kinetic energy of the medicine generated by the dropping medicine, only by the respective slope surfaces 31 and 33 formed in the rectangular funnel shape. Accordingly, the inventors of the present application arranges the partition member 35 sectioning the hopper 14 into a plurality of sections and formed by the corrosion resisting material, for example, the stainless steel. The partition member 35 sections the inner portion of the hopper 14 into four sections by connecting structure bodies 36 and 37 formed by vertically folding an approximately triangular plate material to each other in the folded portion in accordance with a welding process or the like, and controls the movement of the medicine which is in contact with the hopper 14, in the rotational direction. In this case, the partition member 35 is fixed to the hopper 14 by attaching a rear end 38 of the structure body 36 and a front end 39 of the structure body 37 to a rear side slope surface 34 and a front side slope surface 33 of the hopper respectively.

As mentioned above, since there is provided the partition member 35 controlling the movement in the rotational direction of the medicine which is in contact with the hopper 14 having the slope surface, it is possible to control the movement in the rotational direction of the medicine by the partition member 35, and it is possible to efficiently guide the medicine to the outlet portion along the slope surface.

A lower portion of the partition member 35 is provided with a roller screen member 41 in which one end thereof is rotatably supported with respect to the partition member 35, serving as a first curtain absorbing the kinetic energy of the medicine, in correspondence to the outlet portion 14A of the hopper 14. The roller screen member 41 is constituted by a shaft portion 42 rotatably supported by a fixing hook 51 formed by cutting up in the lower portion of the partition member 35, and a plurality of absorbing bodies 43 in which one end is rotatably supported to the shaft portion 42. In this case, in the present embodiment, eighteen absorbing bodies 43 are provided, and the shaft portion 42 is supported so as to be directed in a longitudinal direction of the hopper 1, in such a manner that the absorbing bodies 43 are rotatable toward a lateral direction of the hopper 14. The first curtain (that is, the roller screen member 41) is structured such that a part (a lower end) thereof fasces to the outlet portion (that is, the opening) 14A of the hopper 14. In this case, the absorbing bodies 43 are arranged at a length and in a positional relation such that a leading end thereof is not in contact with the hopper 14 at a time of being rotated by the shaft portion 42.

Since the first curtain (that is, the roller screen member) 41 is provided in correspondence to the outlet portion 14A of the hopper 14, it is possible to efficiently absorb the kinetic energy of the medicine in the outlet portion 14A at the final stage of the hopper, and it is possible to collect the medicine without being broken due to the impact generated by the collision with the kinetic energy even if the medicine speed is made high.

Further, since the first curtain 41 is constituted by the roller screen member in which one end thereof is rotatably supported, the roller screen member 41 rotates around the one end in correspondence to the magnitude of the kinetic energy of the medicine even if the medicine collides with the roller screen member energetically, so that it is possible to absorb and reduce the kinetic energy of the medicine on the basis of the rotation of the roller screen member 41. Further, the roller screen member 41 is constituted by the shaft portion 42 supported to the partition member 35 and a plurality of absorbing bodies 43 in which one end is rotatably supported to the shaft portion. Accordingly, when the medicines having different dimensions are guided to the hopper, the large medicine can be guided to the lower side while the energy of the medicine is absorbed by a lot of absorbing bodies, and the kinetic energy of the small medicine can be absorbed by the corresponding number of absorbing bodies to the magnitude of the medicine. In other words, since the corresponding number of absorbing bodies to the magnitude of the medicine rotate, it is possible to efficiently absorb and reduce the kinetic energy without reference to the magnitude of the medicine. Further, since the roller screen member 41 is attached to the lower end of the partition member 35, it is possible to arrange the roller screen member 41 in conformity to the outlet portion 14A of the hopper 14, and it is possible to efficiently guide the medicine to the outlet portion 14A. Since a part of the first curtain 41 faces to the outlet 14A of the hopper, the medicine colliding with the first curtain 41 is easily guided toward the outlet of the hopper 14, and it is possible to securely collect the medicines in the outlet portion.

Reference numeral 45 denotes a second curtain provided in a direction in which the medicine reflects in the hopper portion 14 with which the medicine coming down from the chutes 12 and 12 is first in contact (that is, a side of the partition member 35), and inhibiting and preventing the medicine from jumping up. The second curtain 45 is constituted by a rod-like support portion 46 in which a rear end and a front end thereof are attached to the rear and front slope surfaces 34 and 33 of the hopper 14, and a transparent resin fin body 47 rotatably attached to the support portion 46.

It is possible to inhibit and prevent the medicine from jumping up, by the second curtain 45 (the fin body 47 in detail) provided in the direction (position) in which the medicine reflects in the hopper portion 14 with which the medicine coming down from the chute 12 is first in contact, and it is possible to effectively collect the medicine without deteriorating the collecting speed of the medicine in the hopper portion. Further, since the second curtain 45 (the fin body 47 in detail) is made of resin, and is rotatably held to the hopper 14 (the support body 46 in detail), it is possible to change the jumping direction in addition to the effect of slightly absorbing the kinetic energy generated by the jumping of the medicine colliding with the hopper 14 so as to lower the energy.

Further, the second curtain 45 is provided with a gap T through which the medicine can pass between a lower end of the fin body 47 and the slope surface 31 or the left side slope surface as one faces (not shown) at a time of being supported to the hopper 14. As mentioned above, since the gap through which eth medicine passes is provided between the fin body 47 and the hopper 14, it is possible to guide the medicine in which the slight energy is absorbed by the second curtain 45 and the direction thereof is changed, so as to slip downward from the gap T along the slope surface of the hopper 14.

Figure 8:
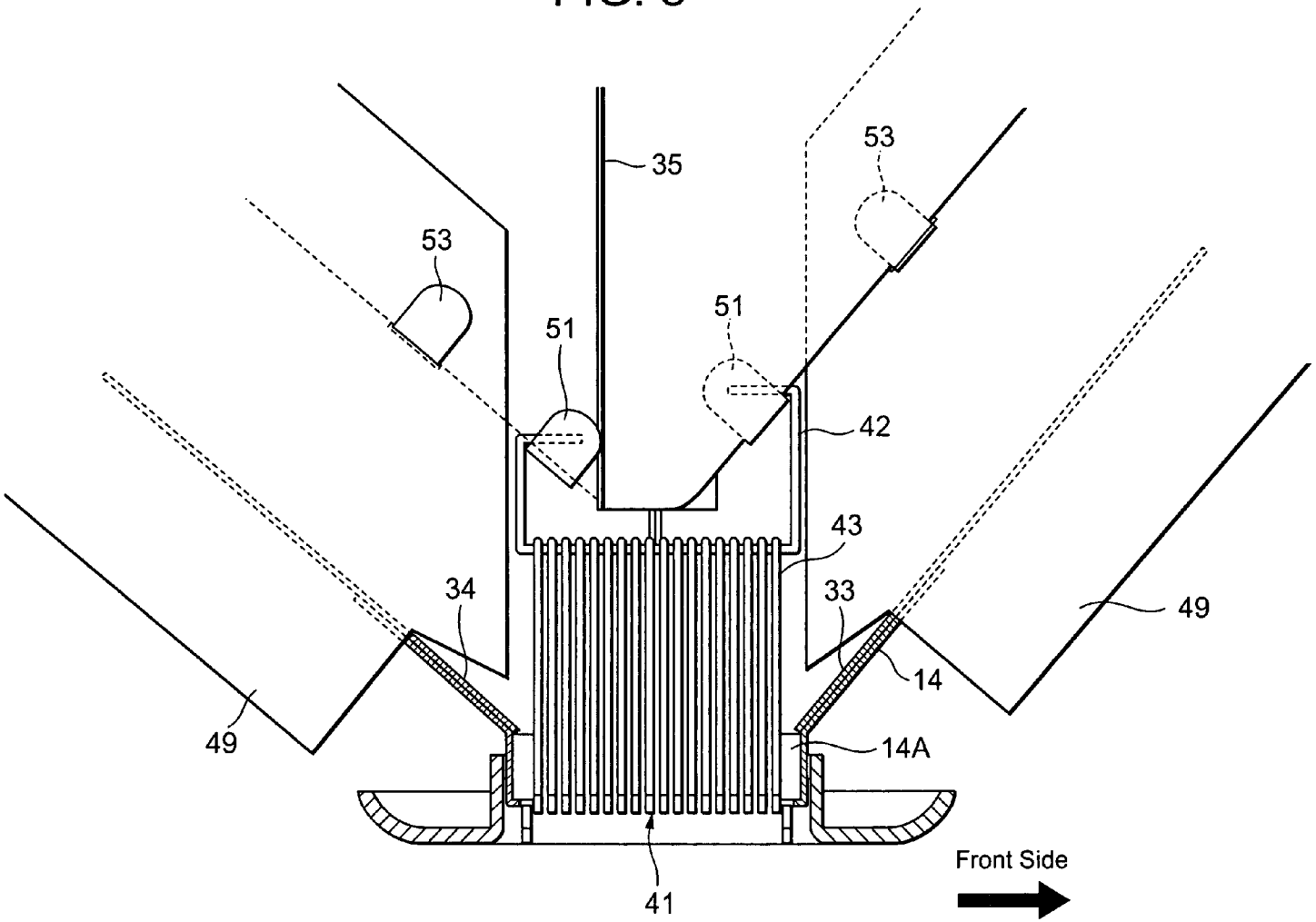
FIG. 8 is a cross sectional view in a partly notched state showing a relation among an outlet portion of the hopper, the partition member and the first curtain in accordance with the present invention.
Figure 9:
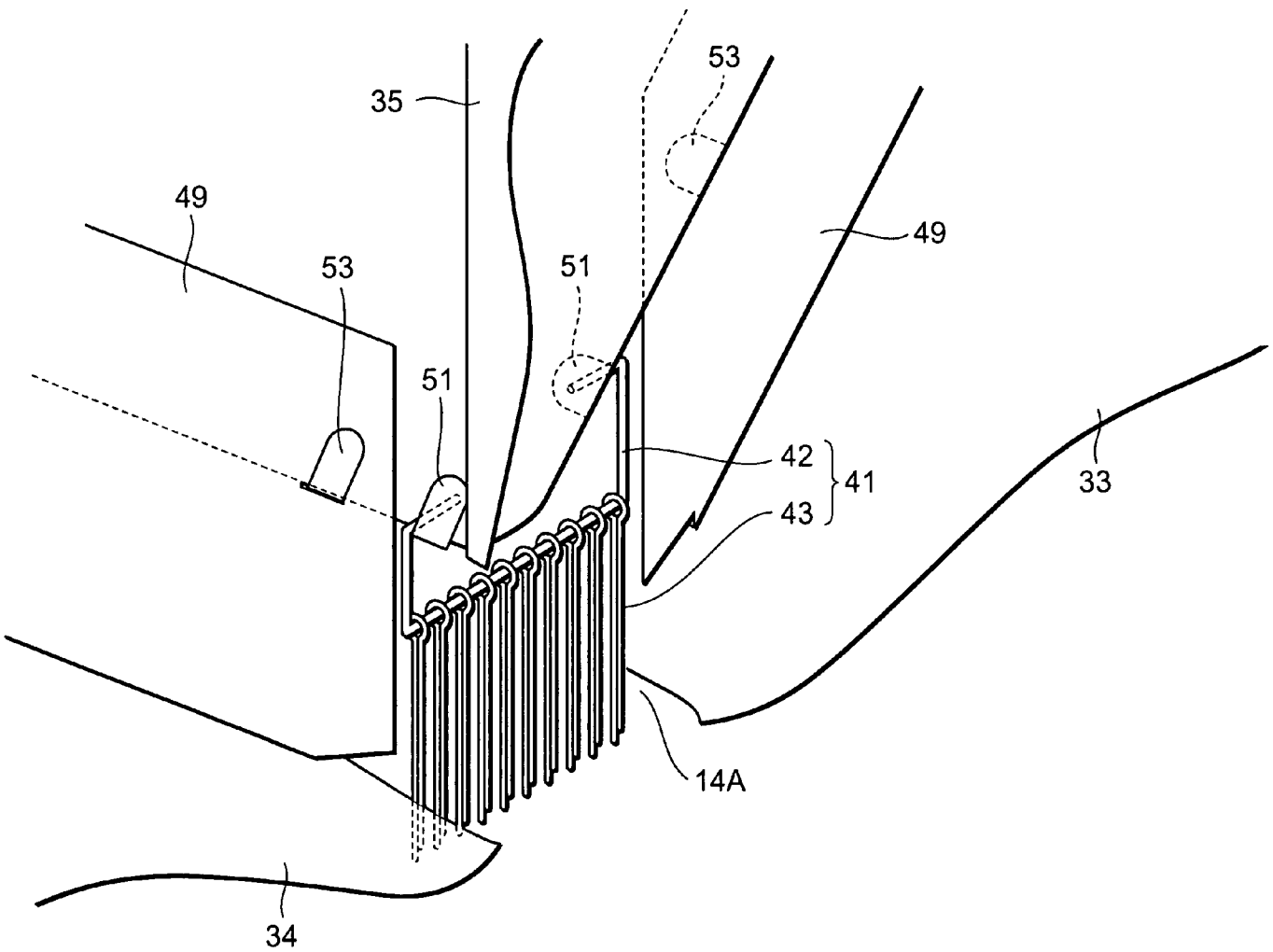
FIG. 9 is a perspective view showing a relation between a roller screen member and the outlet portion in accordance with the present invention.

If the lower end of the partition member 35 is attached in a state of being in contact with the hopper 14, the medicine is reflected due to a rigidity of the stainless steel at a time when the medicine still having a high kinetic energy collides therewith, so that it is impossible to prevent the medicine from jumping up. Accordingly, the lower end of the partition member 35 is provided with a transparent resin third curtain 49 extending through the slope surface of the hopper 14 and absorbing the kinetic energy in the rotational direction of the medicine. Referring to FIG. 8, it is known that the third curtain 49 extends through the hopper 14. The third curtain 49 is rotatably supported by a fixing hook 53 formed by cutting up in the lower portion of the partition member 35, in the same manner as the shaft portion 42 of the first curtain 41. Further, it is possible to efficiently absorb the kinetic energy in the rotational direction of the medicine which is going to move in the rotational direction, by the third curtain 49 provided in the lower portion of the partition member 35 so as to extend through the hopper 14, and it is possible to inhibit the medicine from being broken due to the rotational energy. Further, since the third curtain 49 is made of resin, the third curtain 49 tends to deflect in the rotational direction by the rotational energy, and absorbs a part of the energy on the basis of the deflection. Accordingly, it is possible to guide the medicine in the dropping direction along the slope surface.

Since the third curtain 49 and the first curtain 41 are positioned on one line, it is possible to guide the medicine to the outlet portion while absorbing the kinetic energy by the first curtain 41 finally in the case that the medicine is guided along the third curtain 49.

In accordance with the hopper 14 collecting the medicine on the basis of the first embodiment of the present invention, since there is provided the curtains 41, 45 and 49 for preventing the medicine passing through the chute from jumping up or rotating due to the drop and absorbing the kinetic energy, it is possible to inhibit and prevent the medicine from jumping up and rotating due to the energy of the high speed medicine, and it is possible to efficiently absorb and reduce the kinetic energy. Accordingly, it is possible to inhibit the speed of the medicine from being lowered in addition to preventing the medicine from being broken.

Further, since the partition member 35 and the roller screen member 41 are made of stainless steel, it is possible to provide the medicine feeding apparatus which is excellent in a corrosion resistance, is not corroded by the medicine in the portion collided by the medicine, stands up to a long time use as the apparatus, and is extremely sanitary.

Further, it is possible to efficiently absorb the kinetic energy of the medicine in addition to preventing the medicine passing through the chute from jumping up or rotating in the hopper 14 due to the drop, by inhibiting and preventing the medicine from jumping up by means of the second curtain 45 provided in the direction (the position) in which the medicine coming down from the chute 12 is reflected in the first contact hopper portion 14, controlling the movement in the rotational direction of the medicine which is in contact with the hopper by means of the partition member 35, absorbing the kinetic energy in the rotational direction of the medicine by means of the third curtain 49 provided in the partition member so as to extend through the hopper, and absorbing the kinetic energy of the medicine by means of the first curtain 41 provided so as to correspond to the outlet portion 14A of the hopper 14.

As in detail mentioned above, in accordance with the present invention, since the hopper (14) collecting the medicine has the curtains (41, 45, 49) for preventing the medicine passing through the chute from jumping up or rotating in the hopper caused by the drop and absorbing the kinetic energy, it is possible to inhibit and prevent the medicine from jumping up and rotating due to the energy of the high speed medicine, and it is possible to efficiently absorb and reduce the kinetic energy. Accordingly, it is possible to inhibit the speed from being lowered as well as preventing the medicine from being broken.

Further, in accordance with the present invention, since it is possible to efficiently absorb the kinetic energy of the medicine in the outlet portion existing at the final stage of the hopper, by means of the first curtain (41) provided in correspondence to the outlet portion (14A) of the hopper (14), and it is possible to collect the medicine without being broken even if the medicine speed is made high.

Further, in accordance with the present invention, it is possible to inhibit and prevent the medicine from jumping, by means of the second curtain (45) provided in the direction (at the position) where the medicine coming down from the chute (12) is reflected by the first contact hopper portion (14), and it is possible to effectively collect the medicine without deteriorating the collecting speed of the medicine in the hopper portion.

Further, in accordance with the present invention, since the second curtain (45) is made of resin, and is rotatably held to the hopper (14), it is possible to change the jumping direction as well as slightly absorbing the kinetic energy caused by the jumping of the medicine colliding with the hopper (14) so as to lower the energy.

Further, in accordance with the present invention, since the gap (T) through which the medicine passes is formed between the second curtain (45) and the hopper (14), it is possible to guide the medicine in which the slight energy is absorbed and the direction is changed by the second curtain (45) so as to slip downward from the gap (T) along the slope surface of the hopper (14).

Further, in accordance with the present invention, since the partition member (35) controlling the movement in the rotational direction of the medicine which is in contact with the hopper (14) having the slope surface is provided, it is possible to control the movement in the rotational direction of the medicine by the partition member (35), and it is possible to efficiently guide the medicine to the outlet portion along the slope surface.

Further, in accordance with the present invention, it is possible to efficiently absorb the kinetic energy in the rotational direction of the medicine which is going to move in the rotational direction, by means of the third curtain (49) provided in the lower portion of the partition member (35) so as to extend through the hopper (14), and it is possible to inhibit the medicine from being broken by the rotational energy.

Further, in accordance with the present invention, since the third curtain (49) is made of resin, the third curtain tends to be deflected in the rotational direction by the rotational energy, and absorbs a part of the energy by the deflection, so that it is possible to guide the medicine in the dropping direction along the slope surface.

Further, in accordance with the present invention, since the third curtain (49) and the first curtain (41) are positioned on the same line, it is possible to guide the medicine to the outlet portion while finally absorbing the kinetic energy by the first curtain (41) in the case that the medicine is guided along the third curtain (49).

Further, in accordance with the present invention, since the first curtain (41) is constituted by the roller screen member in which one end is rotatably supported, the roller screen member (41) rotates around the one end in correspondence to the magnitude of the kinetic energy of the medicine even if the medicine is collided with the roller screen member energetically, so that it is possible to absorb and reduce the kinetic energy of the medicine on the basis of the rotation of the roller screen member (41).

Further, in accordance with the present invention, since the roller screen member (41) is constituted by the shaft portion (42) supported to the partition member (35), and a plurality of absorbers (43) in which one end is rotatably supported to the shaft portion, the large medicine can be guided to the lower side while the energy of the medicine is absorbed by a lot of absorbing bodies, and the kinetic energy of the small medicine can be absorbed by the corresponding number of absorbing bodies to the magnitude of the medicine. In other words, on the basis of a plurality of absorbing bodies, since the corresponding number of absorbing bodies to the magnitude of the medicine rotate, it is possible to efficiently absorb and reduce the kinetic energy without reference to the magnitude of the medicine.

Further, in accordance with the present invention, since the roller screen member (41) is attached to the lower end of the partition member (35), it is possible to arrange the roller screen member (41) in conformity to the outlet portion (14A) of the hopper (14), and it is possible to efficiently guide the medicine to the outlet portion (14A).

Further, in accordance with the present invention, since the partition member (35) and the roller screen member (41) are made of stainless steel, it is possible to provide the medicine feeding apparatus which is excellent in the corrosion resistance, is not corroded by the medicine in the portion collided by the medicine, stands up to a long time use as the apparatus, and is extremely sanitary.

Further, in accordance with the present invention, since a part of the first curtain (41) faces to the outlet (14A) of the hopper (14), the medicine colliding with the first curtain (41) tends to be guided toward the outlet of the hopper (14), and it is possible to securely collect the medicine to the outlet portion.

Further, in accordance with the present invention, it is possible to efficiently absorb the kinetic energy of the medicine in addition to preventing the medicine passing through the chute from jumping up or rotating in the hopper (14) due to the drop, by inhibiting and preventing the medicine from jumping up by means of the second curtain (45) provided in the direction (the position) in which the medicine coming down from the chute (12) is reflected in the first contact hopper portion (14), controlling the movement in the rotational direction of the medicine which is in contact with the hopper by means of the partition member (35), absorbing the kinetic energy in the rotational direction of the medicine by means of the third curtain (49) provided in the partition member so as to extend through the hopper, and absorbing the kinetic energy of the medicine by means of the first curtain (41) provided so as to correspond to the outlet portion (14A) of the hopper (14).

What is claimed is:

1. A medicine feeding apparatus comprising:

a main body;

a plurality of tablet cases receiving medicines;

a chute received in said main body and through which the medicine discharged from said tablet case comes down;

a hopper received in said main body, provided in correspondence to a lower side of said chute and collecting the medicines; and a filling apparatus received in said main body and filling the medicines collected by said hopper in a drug packing paper or a container, wherein said hopper has a curtain for preventing the medicine passing through said chute from jumping up or rotating in said hopper caused by drop and absorbing a kinetic energy.

2. A medicine feeding apparatus as claimed in claim 1, wherein a first curtain absorbing the kinetic energy of the medicine is provided in correspondence to an outlet portion of said hopper.

3. A medicine feeding apparatus as claimed in claim 1, wherein a second curtain inhibiting and preventing the medicine from jumping up is provided in a direction (at a position) where the medicine coming down from said chute is reflected by the first contact hopper portion.

4. A medicine feeding apparatus as claimed in claim 3, wherein said second curtain is made of resin, and is rotatably held to the hopper.

5. A medicine feeding apparatus as claimed in claim 3, wherein a gap through which the medicine passes is formed between said second curtain and the hopper.

6. A medicine feeding apparatus as claimed in claim 1, wherein the medicine feeding apparatus is provided with a partition member controlling a movement in a rotational direction of the medicine which is in contact with said hopper having a slope surface.

7. A medicine feeding apparatus as claimed in claim 6, wherein a third curtain extending through said hopper and absorbing a kinetic energy in a rotational direction of the medicine is provided in said partition member.

8. A medicine feeding apparatus as claimed in claim 7, wherein said third curtain is made of transparent resin.

9. A medicine feeding apparatus as claimed in claim 6, wherein said third curtain and said first curtain are positioned on the same line.

10. A medicine feeding apparatus as claimed in clam 9, wherein said first curtain is constituted by a roller screen member in which one end is rotatably supported.

11. A medicine feeding apparatus as claimed in claim 10, wherein said roller screen member is constituted by a shaft portion supported to said partition member, and a plurality of absorbers in which one end is rotatably supported to the shaft portion.

12. A medicine feeding apparatus as claimed in claim 10, wherein said roller screen member is attached to a lower end of said partition member.

13. A medicine feeding apparatus as claimed in claim 9, wherein said partition member and said roller screen member are made of stainless steel.

14. A medicine feeding apparatus as claimed in claim 2, wherein a part of said first curtain faces to an outlet of said hopper.

15. A medicine feeding apparatus comprising:

a main body;

a plurality of tablet cases receiving medicines;

a chute received in said main body and through which the medicine discharged from said tablet case comes down;

a hopper received in said main body, provided in correspondence to a lower side of said chute and collecting the medicines; and a filling apparatus received in said main body and filling the medicines collected by said hopper in a drug packing paper or a container, wherein said hopper has a first curtain provided in correspondence to an outlet portion thereof and absorbing a kinetic energy of the medicine, a second curtain provided in a direction (at a position) where the medicine coming down from said chute is reflected by the first contact hopper portion and inhibiting and preventing the medicine from jumping up, a partition member controlling a movement in a rotational direction of the medicine which is in contact with said hopper having a slope surface, and a third curtain provided in said partition member, extending through said hopper and absorbing a kinetic energy in a rotational direction of the medicine, and absorbs the kinetic energy of the medicine as well as preventing the medicine passing through said chute from jumping up or rotating in said hopper caused by drop.

* * * * *